United States Patent [19]

Chester

[11] 4,190,030

[45] Feb. 26, 1980

[54] CARBURATION SYSTEM

[76] Inventor: Jerry D. Chester, Rte. #2, Sturgis, Mich. 49091

[21] Appl. No.: 863,054

[22] Filed: Dec. 21, 1977

[51] Int. Cl.[2] ..... F02B 31/00; F02B 39/00; F02B 13/03

[52] U.S. Cl. ..... 123/119 R; 123/33 E; 123/119 C; 123/139 AW; 261/30; 261/34 A; 261/116; 261/DIG. 51

[58] Field of Search ..... 123/119 R, 139 AW, 33 E, 123/119 C, 106; 261/30, 34 A, 116, DIG. 51

[56] References Cited

U.S. PATENT DOCUMENTS

| | | | |
|---|---|---|---|
| 1,886,989 | 11/1932 | Trumble | 123/119 R |
| 1,926,010 | 9/1933 | Moore | 261/DIG. 51 |
| 2,012,564 | 8/1935 | Holmes | 261/DIG. 51 |

*Primary Examiner*—Wendell E. Burns

*Attorney, Agent, or Firm*—Blanchard, Flynn, Thiel, Boutell & Tanis

[57] ABSTRACT

A carburation system for supplying a fuel-air mixture to an internal combustion engine includes a hollow base securable to the engine and containing a mixing chamber. A fuel throttling valve and a pressurized air throttling valve supply corresponding fuel and pressurized air jets for aspirating fuel in a finely divided, uniformly mixed form in the pressurized air into the mixing chamber. Atmospheric air is drawn through an atmospheric air valve into the mixing chamber to supply a final mixture of atmospheric air and the premixture of the fuel and pressurized air from the mixing chamber to the engine. An operator-controllable throttle member connects to and controls simultaneously the fuel, pressurized air and atmospheric air valves for positive operator control of all three final mixture components.

16 Claims, 5 Drawing Figures

CARBURATION SYSTEM

FIELD OF THE INVENTION

This invention relates to a carburation system, and more particularly relates to a carburation system for supplying fuel intermixed with pressurized and atmospheric air to an engine.

BACKGROUND OF THE INVENTION

Although carburators for supplying a fuel-air mixture to internal combustion engines have long been known and indeed have been produced in substantial numbers for more than half a century, there continues to be room for and need for improvement, as made apparent by continuing widespread inventive effort in this field. The problem of combining, for example, good drivability of a vehicle equipped with a carburated internal combustion engine, with close control of fuel-air mixture and improved fuel economy is not completely solved and is a problem to which the present invention is directed.

It has been known, for example from U.S. Pat. No. 2,012,564 (Holmes) to, broadly speaking, aspirate fuel with pressurized air and then mix the fuel-pressurized air premixture with atmospheric air. However, use of a single operator controllable throttle member to control individual valving for the atmospheric air, pressurized air and fuel inputs, upstream of the mixing chamber, to maintain at all times complete control over these inputs, is not provided, particularly in combination with an aspiratable, or atmospheric pressure, fuel source. Moreover, despite the substantial age of the Holmes patent, the Holmes structure has not, so far as I am aware, come into wide (if any) use. Accordingly, the objects of this invention include provision of:

A carburation system employing a fuel-pressurized air premixture to enhance fine division of fuel particles in a further, atmospheric air, stream, wherein the final three-component mixture is fed to an internal combustion engine, and wherein all three of the atmospheric air, pressurized air, and fuel components are individually throttled prior to mixture and are simultaneously controlled by the operator through a throttling member.

A system, as aforesaid, in which proportional throttling control of the three input components achieved in a simplified manner through suitable placement of their throttle valves along the length of a pivoted throttling member.

A system, as aforesaid, in which fine division and uniform distribution of fuel particles is enhanced by subjecting fuel entering the mixing chamber to contact with pressurized air from two distinct and differing sets of jets, and in which the air flow rates from the two sets of jets may be proportioned as desired one with respect to the other.

A system, as aforesaid, in which accumulation of fuel particles or droplets on the walls of the mixing chamber is limited or eliminated by spherical configuration of such mixing chamber.

Other objects and purposes of this invention will be apparent to persons acquainted with apparatus of this general type upon reading the following specification and inspecting the accompanying drawings.

Figure 1:
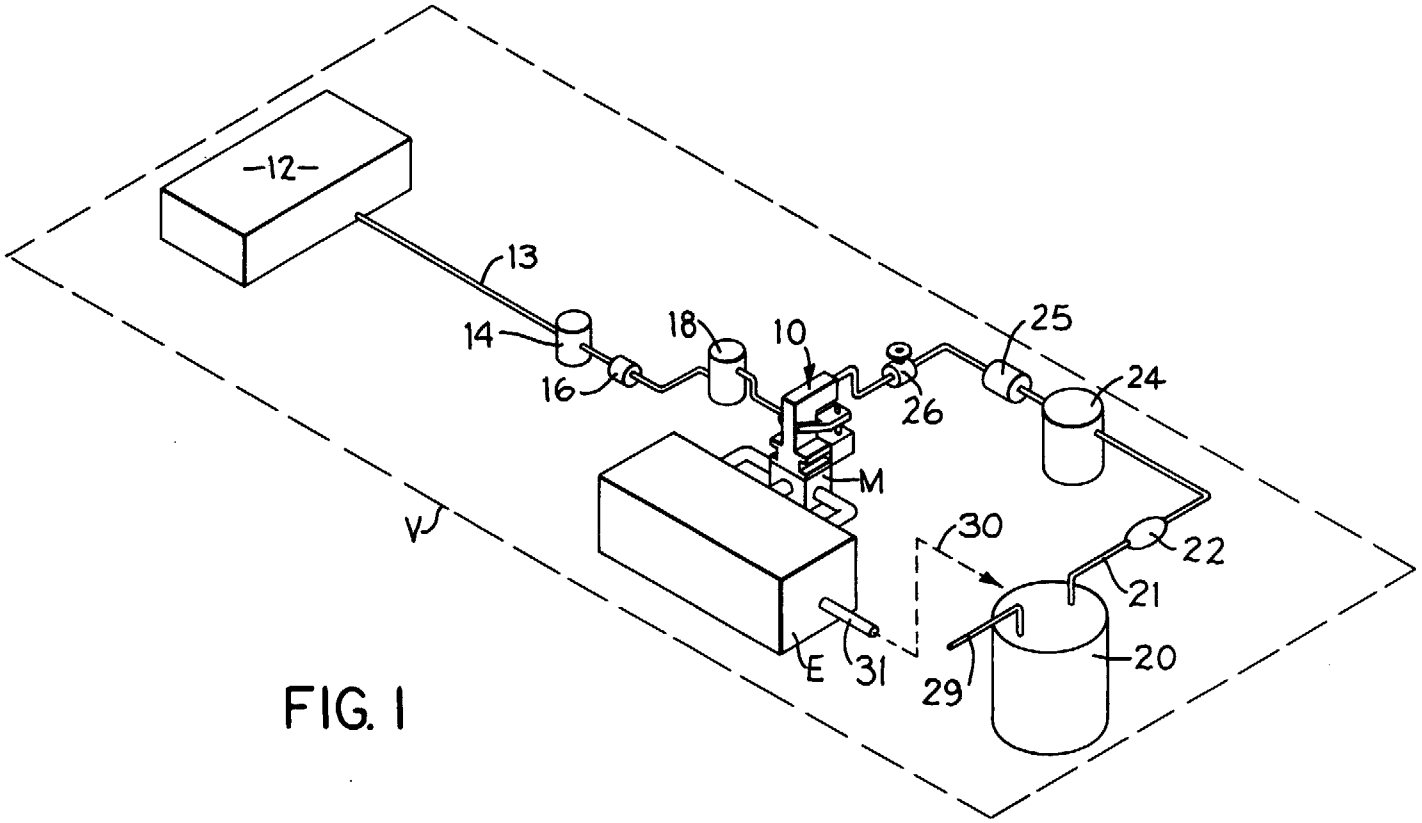
FIG. 1 is a schematic view of a carburation system embodying the invention.

Certain terminology will be used in the following description for convenience in reference only and will not be limiting. The words "up", "down", "right" and "left" will designate directions in the drawings to which reference is made. The word "forward" will refer to the direction of fluid flow through the device. The words "in" and "out" will refer to directions toward and away from, respectively, the geometric center of the device and designated parts thereof. Such terminology will include derivatives and words of similar import.

SUMMARY OF THE INVENTION

The objects and purposes of the invention are met by providing a carburation system for supplying a fuel-air mixture to an internal combustion engine including a hollow base securable to the engine and containing a mixing chamber. A fuel throttling valve and a pressurized air throttling valve supply corresponding fuel and pressurized air jets for aspirating fuel in a finely divided, uniformly mixed form in the pressurized air into the mixing chamber. Atmospheric air is drawn through an atmospheric air valve into the mixing chamber to supply final mixture of atmospheric air and the premixture of the fuel and pressurized air from the mixing chamber to the engine. An operator-controllable throttle member connects to and controls simultaneously the fuel, pressurized air and atmospheric air valves for positive operator control of all three final mixture components.

DETAILED DESCRIPTION

FIG. 1 schematically indicates (in broken lines) a vehicle V equipped with an internal combustion engine E. A final fuel-air mixture is supplied through a conventional intake manifold M by a carburetor 10 of particular preferred construction hereafter described.

Fuel, preferably gasoline or the like, is supplied to the carburetor from a fuel supply, here comprising a conventional vehicle mounted tank 12, through a fuel line 13, fuel pump 14, pressure regulator 16 (for example set at 3 pounds per square inch pressure) and a suitable "zero pressure" means 18. The latter conveniently comprises a float chamber of conventional type, wherein fuel flow thereinto is conventionally controlled by a float valve and fuel is drawn therefrom by the carburetor 10. Preferably, the float, or fuel, level in the float chamber 18 is no higher than the fuel jet, hereafter described, in the carburetor 10 for gravity feed thereto.

Compressed air is supplied to the carburetor 10 from a compressor 20 through an air line 21 incorporating a reverse flow preventing check valve 22, an air holding tank 24, a filter 25, and a pressure regulator valve 26 (preferably set at about 10 psi). In the preferred embodiment shown, the compressor 20 is a conventional air compressor having an air intake schematically indicated at 29 and which is driven as schematically indicated by broken line 30, from an accessory drive shaft 31 of the engine E, or the like.

Figure 2:
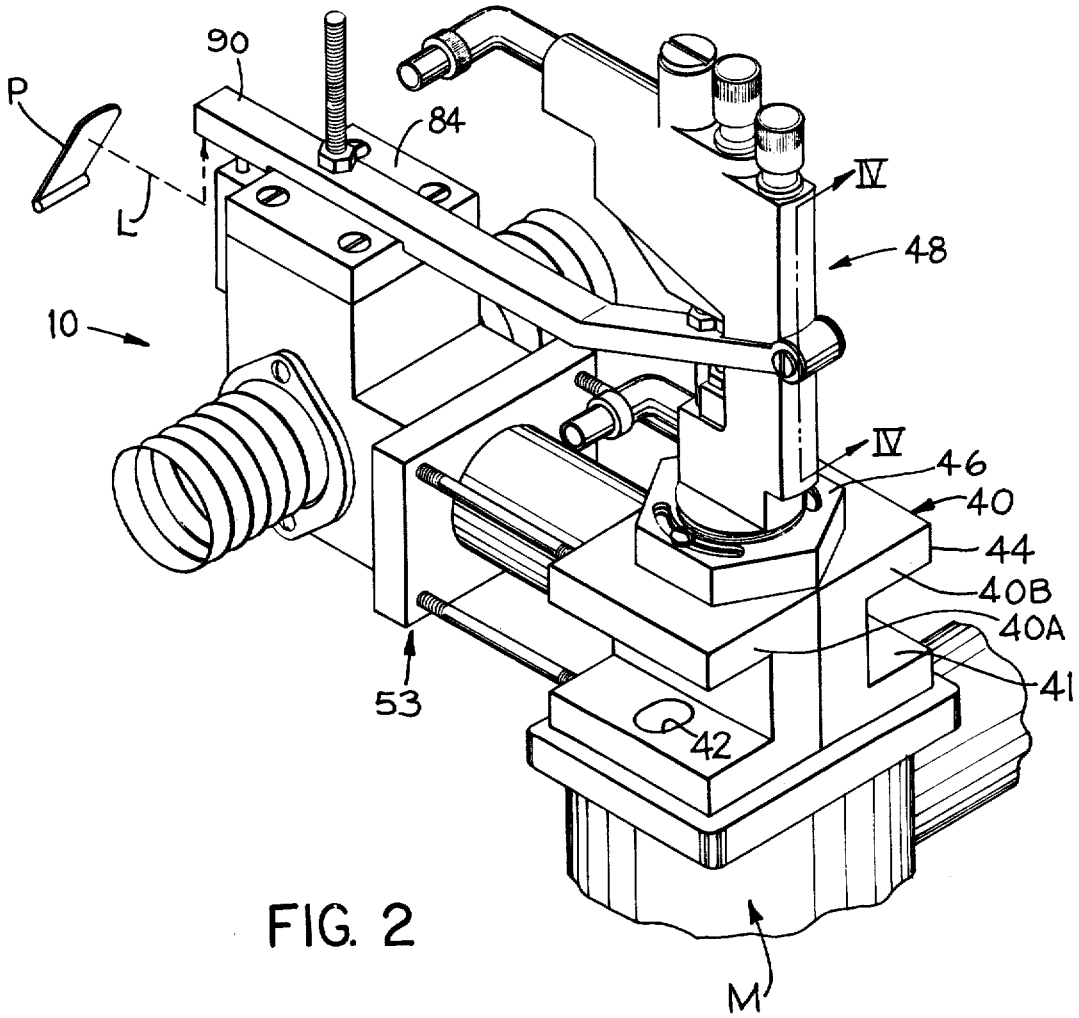
FIG. 2 is a pictorial view of the carburator portion of the FIG. 1 system.

The carburetor 10 (FIGS. 2 and 3) comprises a hollow base 40 having flanges 41 provided with screw holes 42 for securement, by conventional screws not shown, to the inlet portion of engine intake manifold M at the inlet (not shown) thereto. Upper flanges 44 widen the upper portion of the base 40 for support and securement thereon of an adaptor ring 46 which in turn supports a fuel-pressurized air premix unit 48 atop the base 40, as hereafter discussed.

Figure 3:
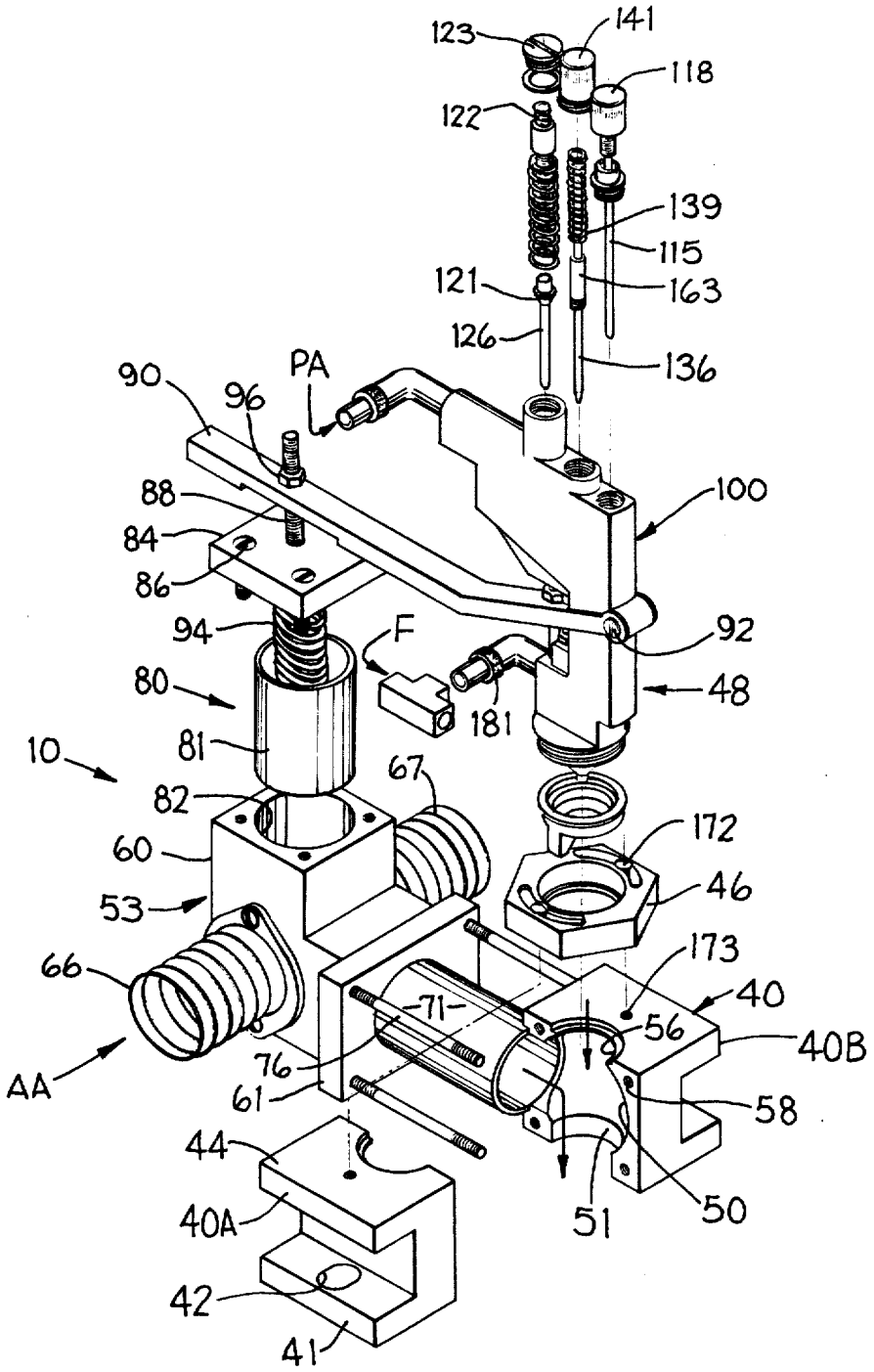
FIG. 3 is an exploded view of the FIG. 2 carburator.

The hollow base 40 contains a spherical mixing chamber 50 (FIG. 3) communicating downward through a final mixture outlet opening 51 with the inlet to the inlet manifold M, laterally through an atmospheric air inlet opening 52 with an atmospheric air unit 53, and upward through a premix opening 56 with the ring 46 and premix unit 48. For convenience in manufacture, in view of the spherical configuration of the mixing chamber 50, the base 40 is split on a diametral plane of the spherical mixing chamber, as seen in FIG. 3. For convenience in securing the adaptor ring 46 to the block 40, the diametral plane of the split is arranged to include a diameter of each of the openings 51, 52 and 56. The two halves 40A and 40B of the base 40 may be secured in their assembled condition of FIG. 2 in any convenient manner, as by pins or screws, holes for which are shown at 58 (FIG. 3).

The atmospheric air unit comprises a block 60, here generally L-shaped, having an attachment flange 61 facing and spaced at a convenient distance coaxially from hollow base opening 52. The block 60 houses an atmospheric air passage 62 (FIG. 4) extending coaxially away from the atmospheric air opening 52 in block 40, and which, in the particular embodiment shown has a T-shape opening in opposite lateral directions, transverse to the axis of opening 52, through the sides of block 60 by means of openings one of which is indicated at 64 and which may communicate, as by means of flexible tubes 66 and 67, with atmospheric air. If desired, the atmospheric air tubes 66 and 67 may terminate in a conventional air cleaner or cleaners. If desired, the atmospheric air inlet to the passage 62, instead of being laterally directed as shown, may be for example in the bottom or remote (from base 40) end wall 68 or 69 (FIG. 4) of the block 60. Variation of such air inlet position may be desired to better accommodate the carburetor to the shape of a given engine or engine compartment.

In the preferred embodiment shown, the atmospheric air passage 62 of block 60 communicates with the spherical mixing chamber 50 through an extension tube 71. As here shown in FIGS. 3 and 4, the ends of extension tube 71 may be recessed, as at 72 and 73 in the opposed faces of base 40 and flange 61. As here shown, the block 60 is secured to and supported in cantilevered fashion on the base 40 by oppositely threaded studs 76 spaced circumferentially around tube 71, threadedly engaging the opposed faces of base 40 and flange 61, and holding the tube 71 under compression. While the passage 62 can be extended to communicate with mixing chamber inlet opening 52 in a desired manner, the arrangement shown of tube 71 and studs 76 conveniently, by substitution of different length elements, permits spacing of the block 60 nearer to or farther from base 40, either to better accommodate the carburetor to the shape of the engine or engine compartment with which it is to be used, or to permit variation of the effective length, of or proportioning accomplished by, the throttling lever 90 hereafter described.

An atmospheric air throttling valve 80 is interposed in the atmospheric air passage 62 and is shiftable to close, or alternatively to open, to the desired degree the passage 62. While use of other valve types, such as a butterfly valve, is contemplated, in the preferred embodiment shown the valve 80 takes the form of a cylindrical plunger 81 reciprocable in a bore 82 extending downward into block 60 to or somewhat beyond the bottom of passage 62, permitting lowering of the plunger 81 into blocking, partially blocking, or non-blocking relation with the passage 62. The plunger 81 is sufficiently snugly received in the bore 82 as to block significant air flow through the passage 62 when the valve plunger 81 is in a closed (here lower) position.

The top of bore 82 is closed by a cover 84 (FIG. 3) securable by screws 86 atop the block 60. An actuating rod 88 fixed at its lower end in any convenient manner to the bottom wall of plunger 81, extends coaxially upward therefrom snugly and slidably through a suitable opening in cover 84 and is adjustably secured to an operator actuable throttling lever 90 near the free, or swinging, end of such lever. The other (rightward in FIG. 3) end of lever 90 is pivoted at 92 on the fuel-pressurized air premix unit 48. Preferably, the valve plunger 81 is urged continuously downwardly with respect to the cover 84, here by a coil compression spring 94 therebetween in coaxial surrounding relation with the rod 88. For adjustability with respect to lever 90, the upper end of rod 88 here extends freely upward through a suitable opening in lever 90 and threadedly carries an adjusting nut 96 atop lever 90, such that loosening of nut 96 permits raising of lever 90 without moving of valve plunger 81.

Figure 4:
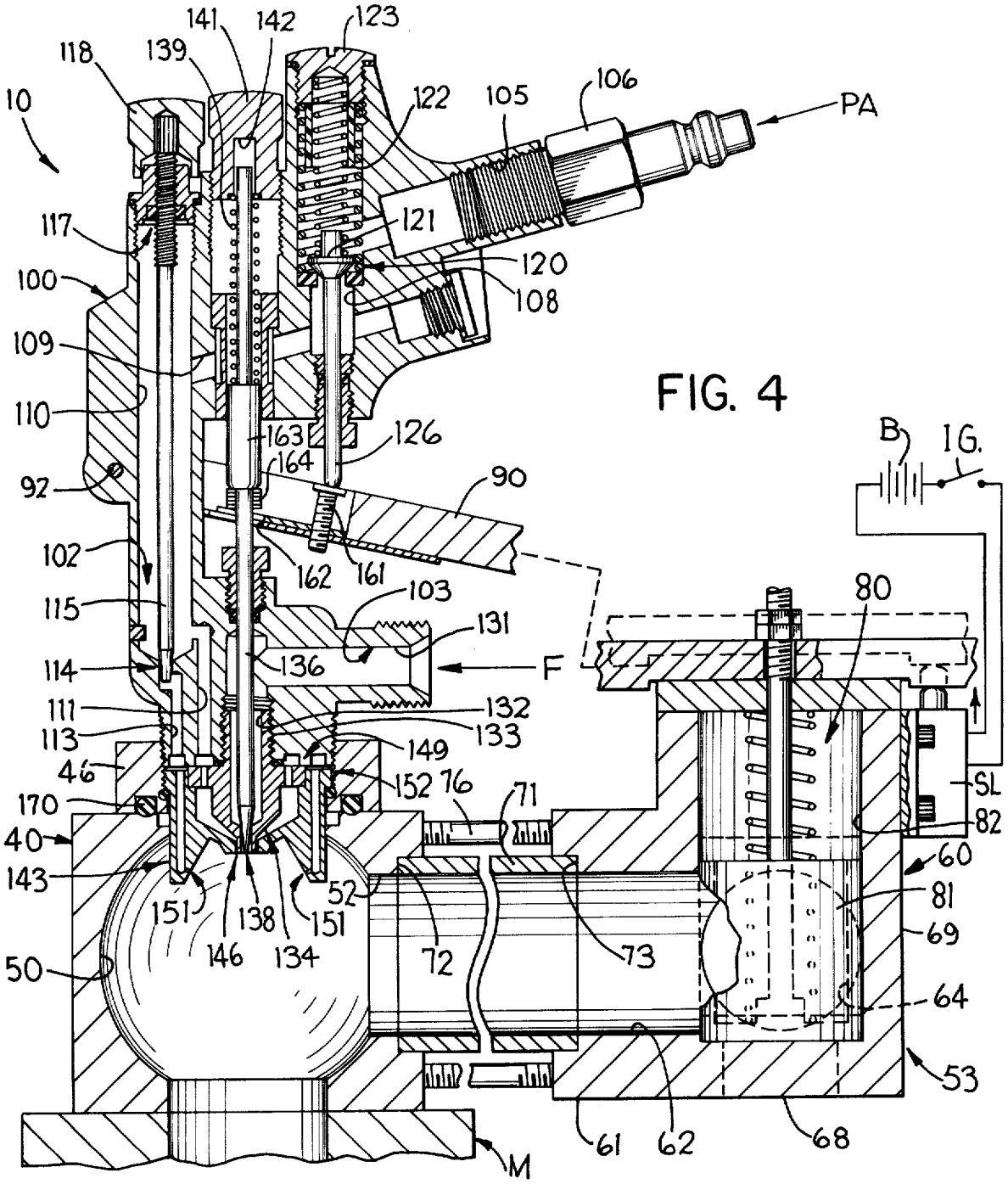
FIG. 4 is an enlarged central cross-sectional view of the carburator structure shown in FIGS. 2 and 3, being a section taken substantially on the line IV—IV of FIG. 2.

In the preferred embodiment shown, a solenoid SL fixed to the block 60 is normally retracted to its position shown in FIG. 4 permitting the lever 90 to be in its lowest (engine ignition off) position. Actuation of the solenoid SL (as by current flow from vehicle battery B due to closure of engine ignition switch IG) raises the lever 90 somewhat (as shown in broken lines) to an engine idling position, hereafter discussed.

Fuel-pressurized air premix unit 48 comprises a body 100, here of somewhat C-shaped form including a pressurized air passage generally indicated at 102 and a fuel passage generally indicated at 103. The pressurized air passage 102 here comprises an inlet portion 105 connectible to the pressurized air supply as through fitting 106 connectible through a suitable conduit to the regulator 26 of FIG. 1. Passage inlet portion 105 connects through serially arranged further passage portions 108, 109, and 110 to an outlet portion 111 of pressurized air passage 102, the latter opening downward from the body 100 toward the premix inlet opening 56 of the hollow base 40. The spur channel 113 parallels outlet portion 101 and communicates at one end (through the seat of a secondary pressurized air needle valve generally indicated at 114 and having an axially adjustable valve needed 115) with the passage 102. Spur channel 113 also opens from the bottom of body 100 toward the pressurized air inlet opening 56 of hollow base 40.

The valve needle 115 here threadedly adjustably engages the body 100, at 117, such that rotation of the knob 118 affixed to the upper end of needle 115 can be employed to preset the opening of the needle valve 114 and thereby proportion the pressurized air flow rate in spur channel 113 with respect to primary pressurized air outlet 111.

A pressurized air throttling valve 120 is interposed in the pressurized air passage 102 and when closed separates portions 105 and 108 thereof. In the embodiment shown, the valve 120 comprises a poppet valve member 121 spring biased at 122 closed against a suitable seat carried by the body 100, the orientation of valve 120 being such that air pressure from inlet 105 further assists holding the valve member 121 in its closed position shown. A cap 123 serves to retain both the valve biasing spring 122 and the valve seat within the body 100. An actuating stem 126 extends from the valve head 121 down out of the upper portion of body 100 toward throttle lever 90.

The fuel passage 103 includes main inlet portion 131 connectible as aforesaid to the flow chamber 18 of FIG. 1, and an outlet portion 132, here continuing into an extension member 133 secured to the bottom of body 100. Interposed in the passage 103 is a fuel throttling valve generally indicated at 134. The fuel throttling valve 134 here comprises an elongate needle valve member 136 whose pointed lower end is normally urged down toward closing relation with the constricted outlet end of fuel passage outlet portion 132, to minimize opening of the fuel jet 138 formed by the latter. In the particular embodiment shown, the elongate needle valve member 136 extends upward slidably into the upper arm of the generally C-shaped body 100, there being spring biased at 139 toward its closed position. A preadjustable knob 141, here threadedly adjustable on the body 100 retains the bias spring 139 and provides a limit surface 142 which acts as a settable limit to maximum opening of the fuel needle valve member 136.

The extension member, or fuel nozzle member, 133 is circumferentially surrounded by an annular pressurized air nozzle member 145 which extends downward from the bottom of body 100 coaxially of fuel nozzle member 133. A set of primary pressurized air jets, or more precisely in the present embodiment shown, a continuous annular primary pressurized air jet, coaxially surrounds, substantially in coplanar relation, the fuel jet 138. The primary pressurized air jet 146 is here formed by a central opening in the outer nozzle member 145 surrounding in close spaced relation the lower end of the fuel nozzle member 133. The primary pressurized air jet 146 is supplied pressurized air from pressurized air passage outlet portion 111, and in the particular embodiment shown through a network generally indicated at 149 and including an annular groove in the bottom of body 100, fed by outlet portion 111, and in turn feeding through openings in the outer portion of fuel nozzle member 133 and thence into an annular space between the nozzle members, which space terminates in the primary jet 146 aforementioned.

Secondary pressurized air jets 151 are spaced axially beyond and radially outward of the primary pressurized air and fuel jets 146 and 138. In the preferred embodiment shown, at least a pair of such secondary jets 151 are provided and same are angled inward and downward to inject pressurized air flows across the axis of the fuel and primary pressurized air jets. The secondary jets 151 may be fed in any convenient manner from the spur channel 113, here, as generally indicated at 152, by means of an annular groove in the bottom of body 100 communicating with spur channel 113 and in turn feeding axial passages in the nozzle member 145, which passages terminate in the jets 151.

As aforementioned, the throttle lever 90 is pivoted at 92 on the body 100 and extends therefrom toward the atmospheric air throttling valve apparatus 80. Nearer however to the pivot 92, the throttling lever 90 is located to engage and open the pressurized air throttling valve 120 and fuel throttling valve 134. In the particular embodiment shown, the throttling lever 90 passes beneath the valve stem 126 and carries a manually preadjustable set screw 161 engageable with the bottom of the valve stem 126, such that raising of the lever 90 to open the atmospheric air throttling valve 80 will also result in opening movement of the pressurized air throttling valve 120. Similarly, the throttling lever 90 is here slotted at 162 for passage of the intermediate portion of fuel valve stem 136 therethrough, which latter is provided with a radial enlarged portion 163 engageable directly with the upper surface of the throttling lever 90 or, in the particular embodiment shown, through one or more adjustment shims 164, the number of which may be manually preadjusted to determine the amount of opening of the fuel throttling valve 134 corresponding to a given pivot position of throttling lever 90 and hence to a given position of opening of the pressurized air throttling valve 120 and atmospheric air throttling valve 80.

The adaptor ring 46 is here threaded onto the lower end of body 100 and is here internally flanged to radially overlap corresponding external flanges on the pressurized air nozzle member 145 to snugly secure the latter coaxially of needle valve member 136 to the bottom of body 100. The adaptor ring 46 lies atop the hollow base 40 with the jets 138, 146 and particularly 151 offset into the spherical mixing chamber 50. Preferably an O-ring seal 170 seals the interface between the adaptor ring 146 and base 40. Screws 172 (FIG. 3) extend downward through circumferential slots in adaptor ring 146 and threadedly engage the top of hollow base 40, at 173, to removably secure adaptor ring 172, and hence the fuel-pressurized air premix unit 48, fixedly atop the hollow base 40. The circumferential slots, with screws 173 loosened, allow partial rotation of ring 46, which threadedly shifts body 100 up or down on the ring 46 to adjust the height of fuel jet 138 with respect to primary pressurized air jet 146, and thereby adjust the fuel-primary pressurized air ratio.

While the fuel-pressurized air premix unit 48 has been described above in substantial detail, and may be constructed by persons of ordinary skill from reference to such description and to the appended drawings, it may also be noted that in one successful embodiment constructed by Applicant, the fuel-pressurized air premix unit was adapted from a particular commercially available paint spray gun, namely the model No. 107-A spray gun marketed by the W. R. Brown Corporation, of Chicago, Ill.

While the carburetor 10 may be fed a single fuel, such as gasoline, via inlet 131 (as through elbow fitting 181 of FIG. 3) it is also contemplated that elbow fitting 181 may be replaced with or fed through a tee with more than one fuel, such feeding being either simultaneous or sequential and such fuels being, for example gasoline and water (or an alcohol-water mix).

During normal ongoing operation of the engine, as with the vehicle cruising at a desired speed, the vehicle operator normally maintains the throttle lever 90 at a "partial open" position, elevated somewhat above its position shown in the drawings. If desired, the operator can open and permit closing of the throttle lever 90 by conventional manipulation of a foot pedal P (typically known as an "accelerator pedal") coupled to the lever 90 as by any convenient linkage schematically indicated at L. Partial lifting of the throttle lever 90 above its position shown correspondingly results in a partial lifting, and hence partial opening of the fuel, pressurized air, and atmospheric air throttling valves 134, 120, and 80. Opening of such valves permits fuel, flowing by gravity from the flow chamber 18 served by fuel system 12, 14, 16, to pass through passage 103 and thence out fuel jet 134 for vaporization by pressurized air flow out primary jet 146. On the other hand, the opened valve 120 permits pressurized air flow from holding tank 124 through passage 122 to provide the primary pressurized air flow out jet 146 and also, in the preferred embodiment shown, due to preset opening of secondary valve 114, to provide the secondary pressurized air flow out jet 151. The relatively high pressure of the air coming through the annular jet 146 vaporizes the fuel from the fuel jet 138, and indeed is intended to result in a pressurized air-fuel mixture wherein the fuel particles are extremely small to provide for unusually efficient combustion in the engine combustion chambers. Also, the high pressure air flow from the primary jet tends to provide a relatively uniform dispersion of the fuel particles in the spherical mixing chamber 50. Uniformity of distribution and small particle size is enhanced by turbulence within the mixing chamber 50 added by the pressurized air flows from the secondary jets 151. In experimental use of the disclosed embodiment of the invention, involving operation body with and without flow from the secondary pressurized air jets 151, improved performance was obtained with the secondary jets 151 supplying pressurized air as above-described.

The throttle lever 90 in its open, or partially open, condition above-described results in a correspondingly open position of the atmospheric air throttling valve 80 (with valve member 82 raised above its closed position shown in FIG. 4) such that atmospheric air is drawn through air passage 62 and into the mixing chamber 50 by the subatmospheric pressure (hereafter "manifold vacuum" or "engine vacuum") existing in the manifold M due to normal engine operation. Upon entering into the mixing chamber 50, atmospheric air is mixed with the aforementioned pressurized air and small fuel particles from jets 151, 146 and 138. It will be understood that in actuality, all four components (fuel, primary pressurized air, secondary pressurized air and atmospheric air) are entering the mixing chamber simultaneously during ongoing engine operation such that the pressurized air blasts from jets 146 and 151 immediately commingle with the incoming atmospheric air and simultaneously with the fuel from jet 138, break such fuel into the aforementioned extremely small particles and uniformly distribute same throughout the air mixture in the mixing chamber 50. The resulting final fuel-air mixture is continuously drawn from the mixing chamber 50 into the intake manifold M of the engine E for combustion.

In substituting the present carburation system for a conventional system on an otherwise stock automobile, improved gas milage was observed with the inventive carburation system. This is believed to result, at least in part, from leaner fuel-air mixtures permitted by finer division, along or with more uniform distribution, of fuel particles in the final fuel-air mixture fed to the engine by the inventive carburation system.

It will be noted that the major portion of the air supplied to the engine, during normal operation, is that supplied through the atmospheric air passage 62, the amount of pressurized air fed through jets 151 and 146 being insufficient for combustion.

The air pressure at the inlet wall 6 typically may be in the range of about 16 to 40 psi, e.g. 17 psi. The check valve 22 (FIG. 1) prevents loss of air pressure from the tank 24 when the engine is shut off, the pressurized air adjustment screw 161 (FIG. 4) normally being adjusted so that the pressurized throttling valve 120 is closed when the throttle pedal P (FIG. 2) is released, regardless of whether or not the engine is turned off or running at idle (solenoid SL deenergized or energized).

With the engine turned off (the ignition switch open) the throttle lever 90 is at its lowermost position shown in solid lines in FIG. 4. Adjustment means 161 and 164 preferably are preset such that the pressurized air throttling valve 120 and fuel throttling valve 134 are shut off as shown. This precludes loss of pressurized air from the downstream side of the holding tank 124 when the engine is shut off, and under the same condition prevents escape of fuel from the jet 138 into the mixing chamber and manifold. Normally, adjusting nut 96 is set so that atmospheric air valve 51 is also closed.

With the engine running at idle, ignition switch IG is closed and energizes the solenoid SL to somewhat elevate the throttle lever 90 (FIG. 4) from its solid line rest position to its dotted line idle position. This lifts adjustment means 164 to raise the fuel valve member 136 and partially open the fuel jet 138 (to its idle setting). Adjustment nut 96 is so adjusted that the atmospheric air valve member 81 is partly opened to its desired engine idle position.

Some additional air issues from the pressurized air jets 146 and 151 at idle since adjustment screw 161 is normally adjusted to engage pressurized air valve stem 126 and slightly open the pressurized air throttling valve 120. Thus, the idle position of throttle lever 90 provides fuel and air (atmospheric and pressurized) in the appropriate amount and mixture for engine idling at a desired speed.

Under all conditions, except with the engine off, the pressurized air flow through the jets 146, 151 occurs.

It may be noted that during the course of development of the present carburation system, prior to the adaption of the spherical shape for the mixing chamber 50, under certain conditions of operations, some condensation of fuel on the walls of the (then cylindrical) mixing chamber was encountered. This condensation was eliminated by the present spherical mixing chamber 50.

Use of a single lever 90 to control all three (atmospheric air, pressurized air and fuel) throttling valves provides a simple yet highly reliable proportional control for changes in the openings of such valves with respect to each other.

Further, simultaneous throttle valving of all of the atmospheric air, pressurized air and fuel inputs provides important benefits both in drivability and fuel economy. For example, with the vehicle decelerating from speed by reason of the operating removing his foot from the pedal P, lever 90 is in its rest position of FIGS. 2 and 4, with atmospheric air valve 80 substantially closed and pressurized air valve 120 substantially closed, creating a high vacuum or minimum pressure, condition which would tend to draw a substantial flow of fuel through passage 103 into the mixing chamber 50 and engine, except that the fuel throttling valve 134 is also nearly closed which sharply limits the amount of raw fuel to be dumped into the engine under deceleration conditions and thereby tending to improve fuel mileage and reduce hydrocarbon emissions.

The fuel valve preset adjustment 164 is normally set to provide a relatively lean fuel-air mixture under part throttle cruise (substantially steady vehicle speed) conditions for best fuel economy. The lean mixture is believed to be enhanced both by the partial throttling of fuel flow by reason of the partially closed condition of fuel throttling valve 134, by relatively high atmospheric air flow speed and the essentially wide open pressurized air throttling valve 120. It will be noted that the valve 120 goes from fully closed to full open gradually over its travel.

Figure 5:
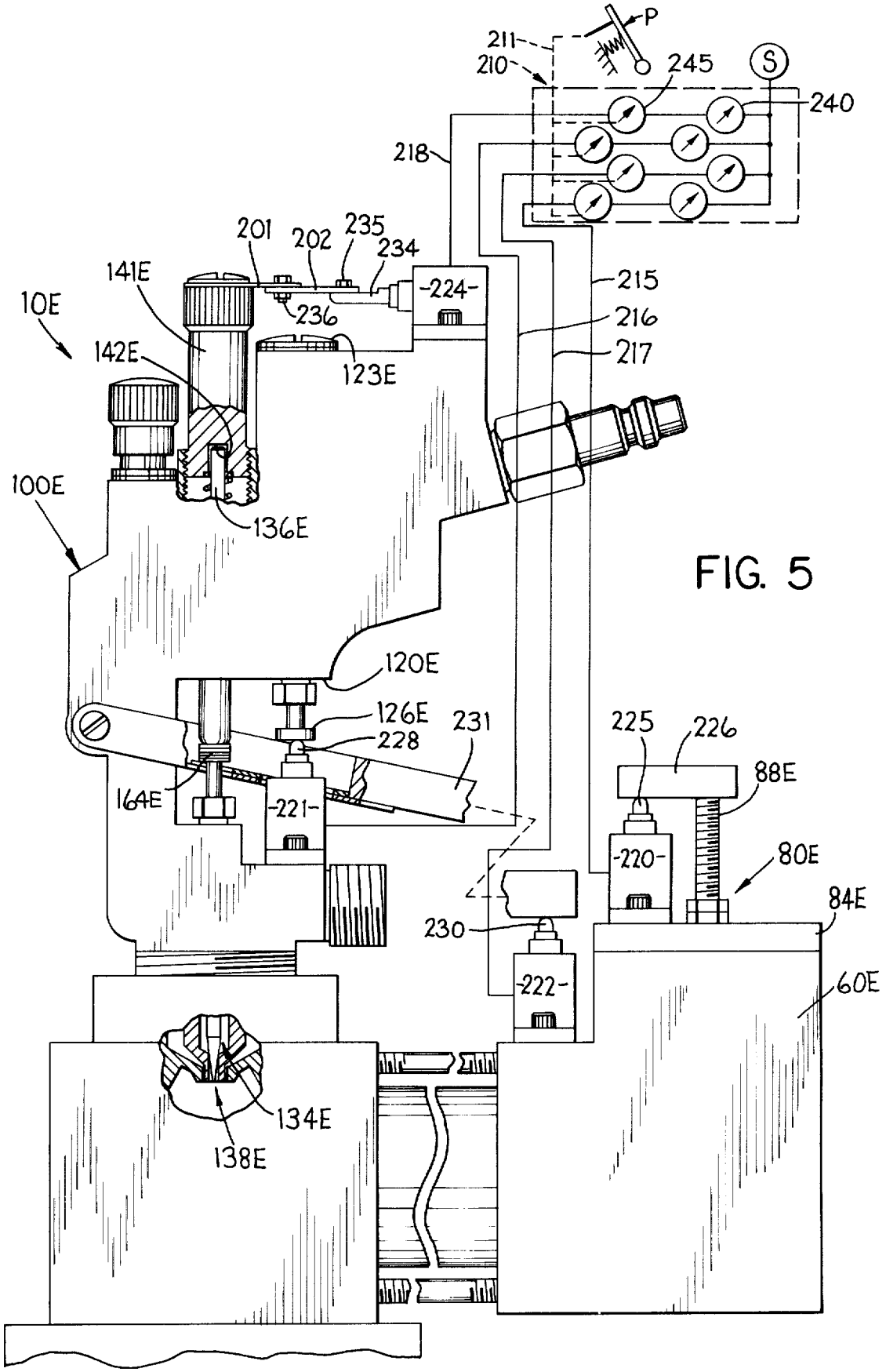
FIG. 5 is an enlarged, partially broken elevational view of a modified carburator control system.

Turning to FIG. 5, portions of the apparatus therein similar to the above-described portions of the apparatus of FIGS. 1–4 will carry the same reference numerals thereas, with the suffix E added. The carburator 10E of FIG. 5 may be generally similar to the carburator 10 of FIGS. 1–4 except as hereafter described.

In FIG. 5, the fuel limit knob 141E, as in the case of knob 141 of FIGS. 1–4, is threadedly adjustable on the carburator body 100E to move its limit surface 142E and thus adjust the maximum permitted opening of the fuel throttling valve 134E. The knob 141E, however, is modified to permit its threaded adjustment in direct response to movement of the throttle pedal P as the latter moves the fuel, pressurized air, and atmospheric air valves (at 164, 126 and 88 in FIGS. 1–4, or correspondingly at 164E, 126E and 88E in FIG. 5). To this end, Knob 141 extends upward to clear the cap 123E and has fixed thereon a radially extending actuator lever 201. Suitable linkage, which for example may comprise the pivotable link 202, may be used to interconnect the lever 201 with the throttle pedal P, either directly, or in any convenient manner through the lever 90 of FIGS. 1–4, for providing a finely adjustable, positive control on the opening movement of the fuel needle valve member 136E.

As the throttle pedal P is depressed by the vehicle operator, the lever 90 of FIG. 4 simultaneously lifts the operating rods 136, 126 and 88 for input of fuel, pressurized air and atmospheric air valves and at a given opening determines a given fuel-air ratio. Should it be desired, however, to decrease the fuel-air ratio (for a leaner mixture), over all or in the latter part of the range of movement of throttle pedal P, the rate of fuel valve opening can be reduced relative to the rate of opening of the air valves, by causing the top end of the fuel valve rod 136E to contact the limit surface 142E of the modified, pedal controlled knob 141E at the desired point in the movement of throttle pedal P. When the throttle pedal controlled knob 141E is used with the lever operated embodiment of FIG. 4, the interconnection between lever 90 and the fuel throttle rod 136 can be made somewhat resilient, as by resilient washers at 164 or a degree of resilient bendability in the adjacent portion of the lever 90, so that opening movement of the pressurized air and atmospheric air valve rods 126 and 88 continues in its original ratio to the movement of the pedal P, whereas the opening rate of the fuel throttle rod 136 is reduced to the lower opening rate of the lever actuated, threaded knob 141E. In this way, lever 90 would provide the force for opening the fuel valve rod 136 but the extent of opening of the fuel valve, at least during the final portion of depression of the throttle pedal P, would be determined by the instantaneous position of the knob 141E, without need for varying the effective diameter or profile of the needle valve structure at fuel jet 138.

Also, as illustrated by FIG. 5, it is contemplated that the fuel, pressurized air, and atmospheric air valves 134E, 120E and 80E, and if desired the fuel limit knob 141E, may all be coupled with the throttle pedal P, for simultaneous operation thereby, other than through the common lever 90 of FIG. 4. Thus, FIG. 5 contrasts with FIG. 4 in providing a single control unit 210 operated, as by suitable mechanical linkage schematically indicated at 211, by throttle pedal P. The control unit 210 in turn energizes, through paths 215–218, corresponding remote actuators, here linear actuators, 220–224. Actuators 220–224 are actuable, here extensible, to substantially proportionally open the atmospheric air valve 80E, pressurized air valve 120E, and fuel valve 134E and, if desired, threadedly raise fuel limit knob 141E.

In the particular example shown, the rod 225 of actuator 220 is extensible to lift a flange 226 fixed to the upper end of atmospheric air throttle rod 88E to raise the latter to the extent of energization of the actuator 220. Conveniently, the actuator 220 is fixed atop the valve cover 84E. Similarly, the actuator 221 may be fixed on the body 100E beneath the pressurized air throttle rod 126E with its rod 228 extensible to lift the enlarged lower end of rod 26E to open the pressurized air valve 120E to the extent of energization of actuator 221. Since the fuel throttling valve rod 136E normally has a relatively short throw, compared to the pressurized air and atmospheric air valves, the rod 230 of actuator 222 may act through a pivot lever 231 to urge upwardly the fuel valve rod 136E to the degree of energization of the actuator 222. The latter may conveniently be fixed on block 60E.

Where desired, a fourth actuator 224 may be fixed on the upper portion of body 100E, with its extensible rod 234 pivotally coupled at 235 to link 202, which in turn is pivoted at 236 to the lever 201 fixed to and extending radially from the threaded limit knob 141E, wherein the knob 141E is threaded upward to the extent of energization of the actuator 224.

In the particular control unit 210 here shown, each of the actuators 220–224 connects to energy source S through its own preproportioning control 240 and throttle pedal actuated control 245. Any convenient energizing medium may be used. For example, the actuators 220–224 may be hydraulically extended, spring returned slave cylinders, wherein controls 240 are valves making available hydraulic fluid to the controls 245, which are master cylinders actuable to displace the desired amount of hydraulic fluid to their respective actuators 220–224 in response to a given depression of the throttle pedal P.

Also contemplated are actuators 220–224 which are air cylinders each having its piston rod extensible, against a progressively increasing spring force, by a progressively increasing air pressure applied to the actuator, wherein the controls 240 may proportion air pressure available to the respective pressure regulators 245 which are variable in output in response to displacement of the throttle pedal P.

On the other hand, the source S may be an electrical power source and the actuators 220–224 electrically energized. One example contemplates receiving stepping motors of linear type at 220–224 responsive to sending stepping motors positioned by throttle pedal P. Also contemplated are continuous or multistep solenoid-type devices at 220–224, for example solenoid-type devices operated in their linear input current to output force range against springs whose restoring force increases with extension of the actuator rods, and in which the controls 240 and 245 are variable resistors, the latter ones controlled and positioned by the position of the throttle pedal P.

In the absence of the lever actuated knob 141E of FIG. 5, resilient means, such as resilient washers or a coil spring, used instead of one or more of the rigid washers at 164 in FIG. 4, tend to progressively compress due to opposition of spring 139 as the lever 90 rises, and such compression permits disproportionately greater opening of the atmospheric air and pressurized air valves 88 and 126 than of the fuel valve 164, for a given upward movement of the throttle lever 90.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A carburation system for supplying a fuel air mixture to an internal combustion engine, comprising:

a hollow base securable to said engine for supplying said fuel air mixture thereto, and having a mixing chamber therein;

fuel-pressurized air premix means having a fuel passage connected to a fuel supply and a pressurized air passage connectible to pressurized air supply, a fuel throttling valve and a pressurized air throttling valve interposed in said fuel passage and pressurized air passage, respectively, for controlling flow therethrough, and premix nozzle means including fuel jet means at the outlet of said fuel passage and pressurized air jet means at the outlet of aid pressurized air passage and located near said fuel jet means for atomizing fuel therefrom and directing pressurized air carrying finely divided fuel particles into said mixing chamber through a premix opening in said hollow base, said fuel-pressurized air premix means being secured at said nozzle to said hollow base;

atmospheric air means having an atmospheric air passage and an atmospheric air throttling valve interposed in said atmospheric air passage for controlling flow therethrough, said atmospheric air passage having an outlet opening to said mixing chamber for supplying a final mixture of atmospheric air and the premixture of fuel and pressurized air from said nozzle means to said engine;

an operator controllable throttle member operatively connected to said fuel throttling valve, pressurized air throttling valve and atmospheric air throttling valve, said fuel throttling valve and pressurized air throttling valve having actuators extending movably from said premix means, said throttle member being a lever with means pivoting same with respect to said premix means, said throttle lever extending from said pivot means past said actuators for said fuel and pressurized air throttling valves to a remote portion, said atmospheric air throttling valve having an actuator actuable by said remote portion of said throttle lever, said atmospheric air and pressurized air and fuel throttling valves being reciprocating spring closed valves each having as its actuator a stem engaging said throttling lever through an axial adjustment means presettable for setting the closed position of the corresponding throttling valve at a desired position of said throttling lever.

2. The system of claim 1, in which the minimum cross section of said atmospheric air passage, with said atmospheric air throttling valve open, exceeds a multiple of the minimum cross section of said fuel and pressurized air passages with the corresponding throttling valves thereof open.

3. The system of claim 1, in which said mixing chamber is spherical.

4. The system of claim 3, in which the central axes of said fuel jet means, atmospheric air passage, and a final mixture outlet opening from said mixing chamber to the adjacent portion of said engine all extend substantially through the geometric center of said spherical mixing chamber.

5. The system of claim 4, in which said atmospheric air passage opens sidewardly into said mixing chamber with its axis transverse to the axis of said final mixture outlet opening, said fuel jet means substantially coaxially opposing said final mixture outlet opening across the axis of said atmospheric air passage.

6. The system of claim 4, in which said atmospheric air passage includes an extension tube laterally spacing said atmospheric air throttling valve from said mixing chamber and extending beneath said throttling member.

7. A carburation system for supplying a fuel air mixture to an internal combustion engine, comprising:

a hollow base securable to said engine for supplying said fuel air mixture thereto, and having a mixing chamber therein;

fuel-pressurized air premix means having a fuel passage connected to a fuel supply and a pressurized air passage connectible to a pressurized air supply, a fuel throttling valve and a pressurised air throttling valve interposed in said fuel passage and pressurized air passage, respectively, for controlling flow therethrough, and premix nozzle means including fuel jet means at the outlet of said fuel passage and pressurized air jet means at the outlet of said pressurized air passage and located near said fuel jet means for atomizing fuel therefrom and directing pressurized air carrying finely divided fuel particles into said mixing chamber through a premix opening in said hollow base, said fuel-pressurized air premix means being secured at said nozzle to said hollow base, said fuel jet means comprising a central fuel jet aimed into said mixing chamber, said pressurized air jet means comprising a first set of pressurized air jets circumferentially surrounding said fuel jet and also aimed into said mixing chamber for asperating and atomizing fuel from said fuel jet and carrying same through said mixing chamber to said engine, said pressurized air jet means further including a second set of pressurized air jets extending beyond said first set into said mixing chamber and aimed convergently substantially toward the axis of said fuel jet to enhance a finely divided mixing of said fuel with air in said mixing chamber;

atmospheric air means having an atmospheric air passage and an atmospheric air throttling valve interposed in said atmospheric air passage for controlling flow therethrough, said atmospheric air passage having an outlet opening to said mixing chamber for supplying a final mixture of atmospheric air and the premixture of fuel and pressurized air from said nozzle means to said engine;

an operator controllable throttle member operatively connected to said fuel throttling valve, pressurized air throttling valve and atmospheric air throttling valve.

8. The system of claim 7, in which said first and second sets of pressurized air jets are fed from said pressurized air throttling valve, said pressurized air passage continuing from said pressurized air throttling valve direct to said first set of pressurized air jets, and including a spur channel by which said second set of pressurized air jets connects to said pressurized air passage and a presettable metering valve interposed in said spur channel for controlling proportioning of the rates of pressurized air flow to said first and second sets of pressurized air jets.

9. The system of claim 8, in which said pressurized air and fuel throttling valves are reciprocating spring closed valves, said fuel-pressurized air premix means including a body containing said fuel and pressurized air throttling valves and fuel and pressurized air passages, an adjustable limit means adjustable on said body and engageable with said fuel valve to limit the maximum opening thereof, said fuel valve being a gradually opening needle valve, said pressurized air valve comprising a poppet valve.

10. The apparatus of claim 9, including an adapter ring securing said premix means body to said hollow base while securing said premix nozzle means to said body and in inserted relation into said mixing chamber.

11. The system of claim 7, including means for supplying fuel at substantially atmospheric pressure to said fuel passage from said fuel supply such that fuel is supplied to said mixing chamber in response to aspiration from said fuel jet means by pressurized air from said pressurized air jet means, and including compressor means and a pressurized air holding tank with intervening reverse flow preventing means and connected in series to the input end of said pressurized air passage.

12. The system of claim 11, in which said means for supplying fuel is a float chamber with an output connected to said fuel passage and a fuel level higher than said fuel jet means.

13. A carburation system for supplying a fuel air mixture to an internal combustion engine, comprising:

a hollow base securable to said engine for supplying said fuel air mixture thereto, and having a mixing chamber therein;

fuel-pressurized air premix means having a fuel passage connected to a fuel supply and a pressurized air passage connectible to a pressurized air supply, a fuel throttling valve and a pressurized air throttling valve interposed in said fuel passage and pressurized air passage, respectively, for controlling flow therethrough, and premix nozzle means including fuel jet means at the outlet of said fuel passage and pressurized air jet means at the outlet of said pressurized air passage and located near said fuel jet means for atomizing fuel therefrom and directing pressurised air carrying finely divided fuel particles into said mixing chamber through a premix opening in said hollow base, said fuel-pressurized air premix means being secured at said nozzle to said hollow base, said fuel-pressurized air premix means further including a body fixedly supporting said fuel jet means and including an adaptor ring threaded on the lower end portion of said body for supporting said body atop said hollow base, said pressurized air jet means comprising a pressurized air nozzle member fixedly supported by said ring and having a pressurized air jet normally located adjacent said fuel jet, and means for securing said adaptor ring to said hollow base for axial adjustment of said fuel jet with respect to said pressurized air jet by threaded adjustment of said ring with respect to said body;

atmospheric air means having an atmospheric air passage and an atmospheric air throttling valve interposed in said atmospheric air passage for controlling flow therethrough, said atmospheric air passage having an outlet opening to said mixing chamber for supplying a final mixture of atmospheric air and the premixture of fuel and pressurized air from said nozzle means to said engine;

an operator controllable throttle member operatively connected to said fuel throttling valve, pressurized air throttling valve and atmospheric air throttling valve.

14. A carburation system for supplying a fuel air mixture to an internal combustion engine, comprising:

a hollow base securable to said engine for supplying said fuel air mixture thereto, and having a mixing chamber therein;

fuel-pressurized air premix means having a fuel passage connected to a fuel supply and a pressurized air passage connectible to a pressurized air supply, a fuel throttling valve and a pressurized air throttling valve interposed in said fuel passage and pressurized air passage, respectively, for controlling flow therethrough, and premix nozzle means including fuel jet means at the outlet of said fuel passage and pressurized air jet means at the outlet of said pressurized air passage and located near said fuel jet means for atomizing fuel therefrom and directing pressurized air carrying finely divided fuel particles into said mixing chamber through a premix opening in said hollow base, said fuel-pressurized air premix means being secured at said nozzle to said hollow base, said premix means further comprising a body containing said fuel and pressurized air passages, actuator means for said fuel throttling valve and pressurized air throttling valve extending movably from said body, said atmospheric air throttling valve also having actuator means, an operator controllable throttle member operatively connected to the actuator means for said fuel, pressurized air and atmospheric air throttling valves, said actuator means of said fuel throttling valve including a stem shiftable by said throttle member to progressively open said fuel throttling valve, a limit member adjustably mounted on said premix means body in the path of opening movement of said stem for limiting opening movement of said fuel throttling valve, and means operatively connecting said adjustable limit member also with said throttle member for shifting said limit member in the direction of valve opening movement of said throttling valve stem so as to vary the fuel throttling valve opening limit dependent on the position of said thottle member.

15. The system of claim 14, in which said actuating means comprise actuators remote from said throttle member and connected with said fuel, pressurized air and atmospheric air throttling valves, said actuators being energizable to actuate said throttling valves, control means operatively connected between said throttle member and actuators and responsive to operator actuation of said throttle member for in turn correspondingly energizing said actuators, said operatively connecting means including a further actuator also operatively connected through said control means to said throttle member for adjusting the position of said limit member with respect to said fuel throttling valve stem.

16. A carburation system for supplying a fuel air mixture to an internal combustion engine, comprising:

a hollow base securable to said engine for supplying said fuel air mixture thereto, and having a mixing chamber therein;

fuel-pressurized air premix means having a fuel passage connected to a fuel supply and a pressurized air passage connectible to pressurized air supply, a fuel throttling valve and a pressurized air throttling valve interposed in said fuel passage and pressurized air passage, respectively, for controlling flow therethrough, and premix nozzle means including fuel jet means at the outlet of said fuel passage and pressurized air jet means at the outlet of said pressurized air passage and located near said fuel jet means for atomizing fuel therefrom and directing pressurized air carrying finely divided fuel particles into said mixing chamber through a premix opening in said hollow base, said fuel-pressurized air premix means being secured at said nozzle to said hollow base;

atmospheric air means having an atmospheric air passage and an atmospheric air throttling valve interposed in said atmospheric air passage for controlling flow therethrough, said atmospheric air passage having an outlet opening to said mixing chamber for supplying a final mixture of atmospheric air and the premixture of fuel and pressurized air from said nozzle means to said engine;

an operator controllable throttle member operatively connected to said fuel throttling valve, pressurized air throttling valve and atmospheric air throttling valve;

actuator means interposed between said throttle member and fuel throttling valve for controlling opening of said fuel throttling valve by the advancing throttle member, said actuator means including a resilient means interposed between said throttle member and fuel throttling valve for permitting a reduction of opening movement of said fuel throttling valve disproportionate to opening movement of said throttle member, and limit means engageable with said fuel throttling valve and cooperative with said resilient means for limiting fuel throttling valve movement to a portion of the possible range thereof while permitting continued movement of said throttle member and air throttling valves beyond the corresponding portions of their ranges, so as vary the fuel/air ratio of said final mixture with the position of said throttle member.

* * * * *